United States Patent [19]

Woodcock et al.

[11] 4,166,417

[45] Sep. 4, 1979

[54] EXPLOSIVE BOOSTING DEVICE FOR LOW-SENSITIVITY BLASTING AGENTS

[76] Inventors: Sidney H. Woodcock, 16233 NE. 12 Pl., Bellevue, Wash. 98008; Michel E. Maes, 14508 SE. 51st St., Bellevue, Wash. 98006

[21] Appl. No.: 864,663

[22] Filed: Dec. 27, 1977

Related U.S. Application Data

[63] Continuation-in-part of Ser. No. 745,792, Nov. 29, 1976, abandoned, which is a continuation-in-part of Ser. No. 713,783, Aug. 12, 1976, abandoned, which is a continuation-in-part of Ser. No. 516,729, Oct. 21, 1974, abandoned.

[51] Int. Cl.[2] ..... F42D 1/04

[52] U.S. Cl. ..... 102/23; 102/24 R; 102/DIG. 2

[58] Field of Search ..... 102/22–24, 102/27, DIG. 2

[56] References Cited

U.S. PATENT DOCUMENTS

| | | | |
|---|---|---|---|
| 2,586,706 | 2/1952 | Parr, Jr. | 102/21 |
| 2,867,170 | 1/1959 | Kibby | 102/23 |
| 3,023,462 | 3/1962 | Taylor et al. | 102/23 |
| 3,037,453 | 6/1962 | Cook et al. | 102/24 R |
| 3,112,699 | 12/1963 | Noddin | 102/1 |
| 3,289,583 | 12/1966 | Silverman | 181/116 |
| 3,359,902 | 12/1967 | Minnick et al. | 102/24 |
| 3,698,316 | 10/1972 | Evans | 102/27 R |

FOREIGN PATENT DOCUMENTS

| | | | |
|---|---|---|---|
| 663864 | 5/1963 | Canada | 102/24 |

*Primary Examiner*—Verlin R. Pendegrass
*Attorney, Agent, or Firm*—Seed, Berry, Vernon & Baynham

[57] ABSTRACT

A boosting device including a thin, cylindrical shell of high explosive, such as PETN, which may be formed by a spiral wrap of detonating cord. The shell is formed around an inert core which is either a solid cylindrical body, a hollow cylindrical body or a web-like structure having radial spokes or a hollow center. Detonation of the shell is initiated at one point on the shell, and the detonation proceeds along opposite sides of the cylindrical shell to a point diametrically opposite the initiation point where the detonation fronts meet thereby producing a shock reinforcing effect. The shock reinforcing effect allows a relatively small amount of explosive to initiate even low sensitivity blasting agents.

14 Claims, 6 Drawing Figures

EXPLOSIVE BOOSTING DEVICE FOR LOW-SENSITIVITY BLASTING AGENTS

CROSS REFERENCE TO RELATED APPLICATIONS

This application is a continuation-in-part of application Ser. No. 745,792 filed Nov. 29, 1976, now abandoned which is a continuation-in-part of application Ser. No. 713,783 filed Aug. 12, 1976, now abandoned, which is a continuation-in-part of application Ser. No. 516,729 filed Oct. 21, 1974, now abandoned.

BACKGROUND OF THE INVENTION

1. Field of the Invention

The present invention relates to booster devices for initiation of low-sensitivity blasting agents. Such boosters are conventionally initiated by means of detonators or detonating cord.

2. Description of the Prior Art

In the past two decades, commercial mining, quarrying and construction blasting operations have undertaken the wide-spread substitution of low-cost "blasting agents" in place of the more traditional "dynamites." The blasting agents are of two basic types: ANFO, which is the trade term for a mixture of ammonium nitrate and fuel oil; and water-gel "slurries." ANFO is the more widely used, principally because of its low cost.

The change from dynamite to blasting agents has created a requirement for a new blasting product, known as a booster or primer (the terms are synonymous). While dynamite can be initiated satisfactorily by means of a blasting cap or detonating cord, the ANFO and slurry blasting agents are relatively insensitive materials which are not cap sensitive (that is, they cannot be detonated directly by blasting caps or by small amounts of ordinary detonating cord). The booster, therefore, is an intermediary explosive charge which in itself can be initiated by either blasting cap or detonating cord and, when detonated, produces sufficient shock and energy to cause the blasting agent to detonate.

When ANFO was first introduced, dynamite was commonly used as a booster in typical quantities of half a stick to three sticks in a bundle. Gradually, however, dynamite has been replaced by "cast" boosters, which consist of mixtures of TNT and PETN, which are high explosives that can be melted and poured into a mold. When cooled, the explosive solidifies into a somewhat homogenous mass. Such cast boosters are usually substantially solid cylinders two to four inches in diameter and a few inches high. Conventionally, a quarter inch diameter hole runs through the center of the cylinder either for placement of a blasting cp or to permit stringing on detonating cord. The weight of such cast boosters varies from one-third of a pound to over a pound.

Attempts have been made in the past to utilize detonating cord to directly initiate low sensitivity blasting agents, but such attempts were commercially unsuccessful because the proper configuration of the detonating cord was not known. Although these prior art detonating cord configurations could produce lower order detonation of low sensitivity blasting agents, they cannot produce a sufficient blast velocity with sufficient speed to be commerically useful in initiating low sensitivity blasting agents.

SUMMARY OF THE INVENTION

A small quantity of high strength explosive, such as PETN, for example, is dispersed and configured into a thin booster shell, preferably of a generally cylindrical shape. Distributing the explosive in this manner allows the booster to produce a relatively large blast front area for a given quantity of explosive in order to produce a "zone of influence" larger than a critical value. In the preferred form, the booster shell comprises a spiral of detonating cord, with the resulting cylinder left hollow, filled with an inert core material, or provided with an open-mesh core. A detonating device positioned adjacent the shell initiates the shell, and the detonation proceeds along opposite sides of the shell before meeting at a point diametrically opposite the initiation point. As the individual detonation fronts meet they reinforce each other to produce an intensified explosive shock which is capable of initiating even low-sensitivity blasting agents with relatively little explosive.

DETAILED DESCRIPTION OF THE PREFERRED EMBODIMENT

Figure 1:
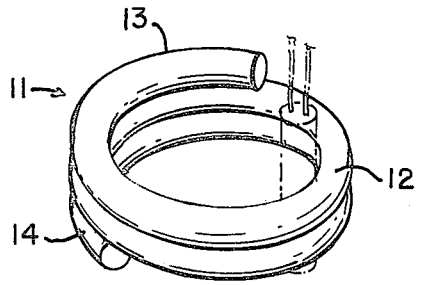
FIG. 1 is an isometric view of one embodiment of a booster made in accordance with the present invention.
Figure 2:
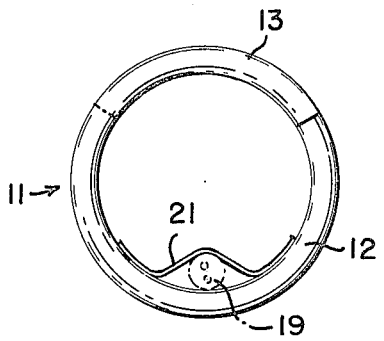
FIG. 2 is a plan view of the booster showing one manner of mounting a detonator.

With reference to FIGS. 1 and 2, an open core embodiment of the explosive booster 11 of this invention may comprise a spirally wrapped detonating cord 12 which is typically two layers high and may have an overlap of the end portions 13,14 relative to one another. Broadly speaking, the booster 11 has a relatively thin explosive storage zone surrounding a center non-explosive zone. The detonating cord 12 is a standard article of commerce. The preferred type has a center core **12*a*** which includes a high explosive and is encased in a textile braid. This core is covered by various combinations of materials, such as textiles waterproofing compounds, plastics, etc., depending upon the physical conditions to be encountered in use.

The explosive in the center core **12*a*** is typically PETN or RDX, the latter being used when temperatures above about 284° F. are to be encountered. PETN is preferred for most applications; it is difficult to ignite and relatively difficult to detonate, but is sensitive to initiation by commerical detonators. When once properly initiated, PETN explodes with great violence and has brisance of a high order.

In the practice of the present invention, a linear foot of 200 grain per foot PETN "Primacord," a product of the Ensign-Beckford Co., Simsbury, Conn., has been used to form the indicated spiral wrap thereby forming a booster having a diameter of about 2½ inches.

The specific value selected for the overall diameter of the booster is not critical, but it should be larger than about 1.5 inches up to about 6 inches, with 2¼ to 3 inches preferred. Although the intensity of the explosive shock may be the primary factor in initiating low sensitivity blasting agents, the size of the blast front area is also a significant factor since a booster must produce a "zone of influence" which is larger than a critical value. Boosters having a diameter larger than about 1.5 inches provide sufficient disbursement of the explosive to achieve the required blast front area. It is also important that the explosive be distributed in a configuration that is taller than it is thick. For example, a pair of vertically spaced coils are satisfactory while a pair of coils arranged with one inside the other are not satisfactory. The height of such an explosive zone should be at least ½ inch to 6 inches, with ¾ inch to 1¼ inch preferred. The explosive strength of the explosive "shell" should be at least 600 grains per lineal foot of PETN or equivalent strength explosive if a single strand or continuous vertical surface is used with 800 to 1200 grains perferred. Alternatively, the shell should have an explosive strength of at lease 300 grains per lineal foot if multiple strands are used which provide for additional shock reinforcement, with 400 to 800 grains preferred. In no instance however, should the explosive load per strand be below 100 grain per lineal foot, with 200 to 400 grain preferred.

The generally cylindrical configuration of the spiral wrap is maintained by taping, use of suitable adhesives, containment in a plastic or aluminum case thin enough not to interfere with the shock wave produed upon detonation, wrapping around a spool or inert core, any combination of the foregoing, or any other suitable means which provides sufficient structural integrity during handling and use.

Figure 3:
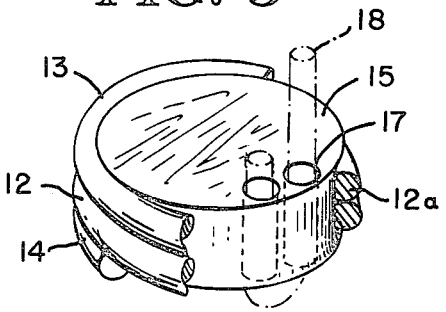
FIG. 3 is an isometric view, partly broken away, illustrating another embodiment of the booster provided with an inert solid core.
Figure 4:
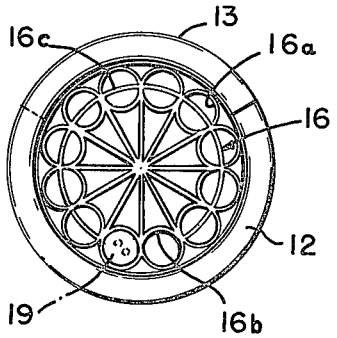
FIG. 4 is a plan view of another embodiment of the booster provided with an inert open-mesh core.

FIGS. 3 and 4 illustrate, respectively, the use of solid and open-mesh spools or cores 15 and 16. The solid embodiment may be formed of a suitable inert material, such as wood, wax, concrete, rubber, plaster or plastic, which will provide the desired degree of structural support and additional weight to aid in lowering the device into a blast hole. If desired, for additional weight the core 15 can be extended axially, giving a core which is longer than the maximum height of the explosive zone of the booster. Preferably, the core 15 is provided with one or more holes 17 for the attachment of initiating detonating cored 18 looped through the holes as indicated in FIG. 3, or for a detonator placed in one of the holes. It will be noted that the holes 17 are placed directly adjoining the explosive shell formed by the spiral wrap in order to insure reliable initiation.

The open-mesh spools or core 16 may have any pattern or webs or spokes providing openings for the passage of granules or prills of blasting agent in the blast hole and yet guaranteeing the proper locating of the detonating device for initiating the booster. It may be formed, for example, of polyethylene. In the pattern illustrated in FIG. 4, the rim of the core is provided by a plurality of contiguous rings **16*a* joined to spokes 16*b*. Two of the rings 16*a* are left open for insertion of a detonator 19 or of an initiating detonating cord in the same manner as previously described respecting holes 17. The other rings 16*a* are crossed by web portions 16*c* so that they cannot be used to receive the detonating device, and the openings between the spokes 16*b*** are of such a size and shape as to preclude their use for insertion of the detonating device.

When the booster shell 11 does not have a core, the attachment of a detonator 19 or detonating cord for initiation purposes can be accomplished by a tape 21 held in position by adhesive or other suitable means.

The detonator 19 or detonating cord 18 initiates the explosive shell formed by the spirally wrapped detonating cord 12 at a single initiation location. The detonator 18 or detonating cord preferably extends along the entire axial length of the wraps of detonating cord 11 so that all of the wraps are simultaneously initiated. The detonation then proceeds from the initiation location along opposite faces of the cylindrical sidewalls before meeting at a point diametrically opposite the initiation location. The concentration of explosive in the cord 12 is sufficient to cause the detonation to jump from one cord to an adjacent cord so that axial, as well as circumferential, propagation of the detonation occurs even if all of the wraps are not simultaneously initiated.

When the detonation fronts collide with each other at a point diametrically opposite the initiation point a shock reinforcing effect is produced which generates an outwardly directed pressure wave having a magnitude which is greater than what would be possible with the quantity of explosive in the shell if arranged in a different configuration. The detonator 19 or detonating cord 18 is preferably positioned diametrically opposite the portion of the booster shell where the end portions 13, 14 of the spiral wrap overlap relative to one another and the axial dimension of the shell is greater. This is done in order to maximize the effect of shock reinforcement achieved when the detonation fronts meet after traveling oppositely around the booster from the point of initiation.

Figure 5:
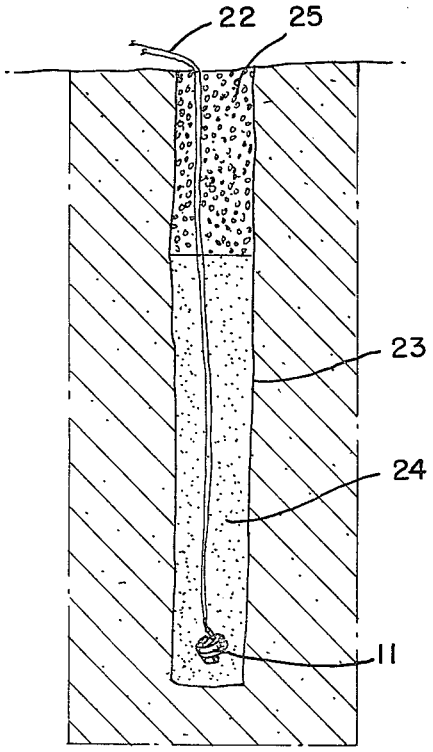
FIG. 5 is a longitudinal cross-sectional view of a blast hole illustrating use of the booster being initiated by an electric detonator.

FIG. 5 illustrates a typical application of the invention. The booster shell 11, with an attached electric detonator, is lowered by means of the electric leads 22 of the detonator to the bottom of a blast hole 23 drilled in the formation to be blasted. The main charge of blasting agent 24, usually in prill form, is poured in and stemmed at the top with sane, rock or other suitable material 25. When the detonator is set off, causing the booster to detonate, it in turn produces a shock wave of sufficient strength to cause the blasting agent 24 to detonate.

The physical placement of the booster 11 may vary, depending on blasting practice, from the bottom of the charge to the top or anywhere in between. Since the open-mesh core or spool embodiment 16 provides less resistance than the sold embodiment 15 to flow-by of the blasting agent during filling of the blast hole 23, it may be preferred when the booster is spaced well above the bottom of the blast hole. It will be appreciated that more than one booster may be used to achieve a required blast configuration.

Figure 6:
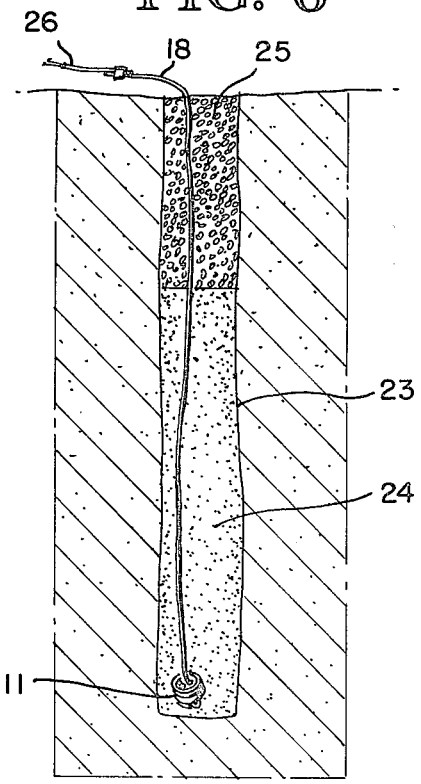
FIG. 6 is a view taken like FIG. 5, but illustrating the arrangement when the booster is initiated by a detonating cord.

FIG. 6 illustrates a variation in which the booster 11, immersed in the blasting agent 24 contained in blast hole 23, is initiated with a length of detonating cord 18 which is itself separately initialized at some point with a detonator having leads 26. Other methods of use will be apparent to those skilled in the art.

As previously indicated, a typical prior art booster contains from one-third of a pound to over a pound of explosive. By comparison, a booster made in accordance with the present invention need only contain about 1/35th of a pound of high explosive to cause initiation of the blasting agent equivalent to that of the conventional commercial boosters containing ten or more times the amount of high explosive. The hollow, generally cylindrical arrangement of the small quantity of explosive needed to produce the invention is significant since it has been shown in tests using comparable quantities of the same explosive (1/35th of a pound of PETN) packaged in a one foot length of cord with a nominal outside diameter of one quarter of an inch, or packaged as a solid cylinder three quarters of an inch in diameter and two inches high, that satisfactory initiation of the blasting agent will not be achieved.

Typical of the tests conducted were those in which a spiral of the indicated detonating cord measuring two inches in diameter and nominally three quarters of an inch high and containing 1/35th of a pound of PETN explosive was used to initiate a three inch diameter column of ammonium nitrate-fuel oil blasting agent five feet high. The spiral repeatedly produced complete detonation of the blasting agent column. By comparison, a straight piece of detonating cord containing the same quantity of PETN explosive did not initiate the blasting agent, and the same quantity of detonating cord cut into two inch lengths and tightly bunched to form a cylinder-like bundle only caused partial detonation of the blasting agent. This demonstrates that contrary to past thinking and practice in the art, a relatively thin shell of explosive having a comparatively large surface area configured to produce a shock reinforcing effect, rather than a concentrated source of the same quantity of explosive, is the most effective as a booster in causing initiation of the blasting agent.

It will be apparent that the invention offers several advantages in commerce. Since the explosive load is very much reduced compared to conventional boosters to achieve the same result, there are economies in explosive cost and manufacturing cost. The thin shell boosters are also safer because of the smaller explosive quantity and, under certain circumstances, can be transported, handled and stored under less stringent regulations than conventional boosters, resulting in logistic economies.

We claim:

1. A method of initiating a low sensitivity blasting agent, comprising:
   - spirally wrapping a length of detonating coil a plurality of turns about an inert center zone to form a coil with multiple wraps surrounding said center zone;
   - positioning a remotely ignitable detonating means closely adjacent said coil;
   - embedding said detonating cord and detonating means in said low sensitivity blasting agent; and
   - triggering said detonating means thereby initiating said detonating cord such that a pair of detonation fronts propagate away from each other and meet detonation fronts propagating toward said detonation front to produce a shock reinforcing effect for initiating said low sensitivity blasting agent.

2. The method of claim 1 wherein said spirally wrapped detonating cord has overlapped end portions, and said detonating means is positioned diametrically opposite said end portions so that said detonation fronts meet each other at said overlapped end portions.

3. The method of claim 2 wherein adjacent wraps of said detonating cord are in contact with each other and the explosive concentration of the explosive core of said detonating cord is of sufficient magnitude to allow detonation of said cord to proceed from one wrap directly to the next adjacent wrap such that detonation of said cord is able to propagate from said initiation location in an axial, as well as circumferential direction.

4. The method of claim 3, wherein said detonating cord includes an explosive core having a concentration equivalent to at least 100 grains of PETN per lineal foot, and the total explosive concentration of all said coils is equivalent to at least 300 grains of PETN per lineal foot.

5. The method of claim 4 wherein the explosive concentration of all of said coils is equivalent to between 400 and 800 grains of PETN per lineal foot.

6. The method of claim 4 wherein the explosive concentration of said detonating cord is equivalent to between 200 and 400 grains of PETN per lineal foot.

7. The method of claim 1 wherein the outside diameter of said spiral wraps of detonating cord is greater than 1.5 inches such that the blast front produced by said boosting device has an area larger than a critical value.

8. The method of claim 1 wherein said inert zone has a cylindrical inert solid core therein having a diameter substantially greater than the thickness of said shell.

9. The method of claim 1 wherein said inert zone has an inert core therein comprising a web having a cylindrical rim extending around a plurality of radial spokes.

10. The method of claim 1 wherein said inert zone has an inert core therein formed with an opening adjacent said wraps of detonating cord for receiving said detonating means for initiating said boosting device.

11. A method of initiating a low sensitivity blasting agent, comprising:
   - providing a cylindrical, relatively thin shell of explosive material surrounding an inert center zone, said shell having an explosive strength equivalent to more than 600 grains of PETN per lineal foot;
   - positioning a remotely ignitable detonating means closely adjacent said explosive shell;
   - embedding said explosive shell and detonating means in said low sensitivity blasting agent; and
   - triggering said detonating means thereby initiating said explosive shell such that a pair of detonation fronts propagate away from each other and meet detonation fronts propagating toward said detonation fronts to produce a shock reinforcing effect for initiating said low sensitivity blasting agent.

12. The method of claim 11 wherein said explosive shell comprises a length of detonating cord having an explosive core spirally wrapped about said inert center zone, and fastening means for retaining said detonating cord relative to said shell.

13. The method of claim 11 wherein the explosive concentration of said explosive shell is equivalent to 600 grains of PETN per lineal foot.

14. The method of claim 13 wherein the explosive concentration of said explosive shell is equivalent to between 800 and 1200 grains of PETN per lineal foot.

* * * * *